US005161853A

United States Patent [19]

Polett

[11] Patent Number: 5,161,853

[45] Date of Patent: Nov. 10, 1992

[54] FLEXIBLE BAG

[76] Inventor: Walter J. Polett, P.O. Box 55, Mount Holly, N.J. 08060

[21] Appl. No.: 786,195

[22] Filed: Oct. 31, 1991

[51] Int. Cl.[5] ..... B65D 33/14

[52] U.S. Cl. ..... 383/25; 383/17; 383/20; 383/24

[58] Field of Search ..... 383/6, 7, 17, 20, 22, 383/24, 25, 41, 67, 71, 72, 75

[56] References Cited

U.S. PATENT DOCUMENTS

| | | | |
|---|---|---|---|
| 3,789,897 | 2/1974 | Saito | 383/67 X |
| 4,010,784 | 3/1977 | Nattrass et al. | 383/20 X |
| 4,499,599 | 2/1985 | Polett et al. | 383/24 X |
| 4,573,204 | 2/1986 | Polett | 383/71 X |

FOREIGN PATENT DOCUMENTS

| | | | |
|---|---|---|---|
| 119743 | 9/1984 | European Pat. Off. | 383/75 |
| 2097755 | 11/1982 | United Kingdom | 383/17 |
| 2098581 | 11/1982 | United Kingdom | 383/7 |
| 2132171 | 7/1984 | United Kingdom | 383/20 |
| 2194770 | 3/1988 | United Kingdom | 383/71 |

*Primary Examiner*—Stephen Marcus
*Assistant Examiner*—Jes F. Pascua
*Attorney, Agent, or Firm*—Norman E. Lehrer

[57] ABSTRACT

A flexible bulk container including a bag portion comprised of a top wall, an encircling side panel and a bottom wall. The top wall has a filling spout therethrough for access to the bag interior. The flexible bag is cube-shaped having four corners. At each corner a loop member extends above the top wall. The loop member is comprised of a straight section and a loop section. The straight section extending below the top wall is sewn to the side wall adjacent to each corner. Pockets are similarly sewn to an area adjacent each corner and cover the straight portion of the loop members. Semi-rigid tubular members with open ends enclose the straight portion of the loop members and extend downward into the pockets and upward above the top wall. The loop portions of the loop members extend above the top open end of the tubular members. A continuous elongated hoop passes freely through each loop and is the means for a lifting mechanism to engage the flexible bag. The bag can be lifted using heavy machinery by engaging any section of the elongated hoop. No manual assistance to align the lifting mechanism with the bag is required other than the skills of the machine operator. Once engaged and lifted upwards, the hoop pulls through the loops and upward, collapsing the tubular and loop members toward each other. The bag stays in an upright orientation as the hoop moves toward the center of the bag regardless of where it is engaged along the lifting hoop.

7 Claims, 2 Drawing Sheets

FLEXIBLE BAG

BACKGROUND OF THE INVENTION

The present invention is directed toward a flexible bulk container and more particularly toward such a container which has a raised lifting hoop which can be engaged by a hook or by the forks of a forklift or the like. Furthermore, it is directed to a container which does not assume a tilted orientation but stays substantially upright when lifted.

Large, flexible fabric bags for containing and transporting granular or powdered bulk material have been used for many years and their use is becoming increasingly more popular. This is primarily due to their relatively low cost and to the fact that when the bags are empty they take up very little space and are relatively light.

When filled, the flexible bulk containers may carry a cubic meter or more of material and may weigh in excess of two tons. Straps are normally provided and are securely fastened to the bags adjacent the top thereof to form lifting loops which can cooperate with the forks of a forklift truck or other lifting device when it becomes necessary to transport a full bag. Containers of this type are shown, for example, in U.S. Pat. Nos. 4,010,784; 4,207,937; 4,300,608; 4,301,848; 4,499,599 and 4,573,204.

Prior art containers normally include straps or lifting loops which are secured to the bags adjacent the corners or edges thereof. When lifting these containers, it is necessary for the forks of the forklift to engage all of the lifting loops or, at the very minimum, loops at opposite corners. While it might be possible to lift a prior art bag utilizing only one of the lifting loops, this would cause the bag to tilt when lifted therefore making it difficult to place the bag down again. This is due to the fact that the tilted bag would tend to fall onto its side as it was being again lowered onto a flat surface.

In U.S. Pat. No. 821,177 to Leue, a sack having a plurality of flexible eyes arranged on its exterior and having a flexible hoop passing therethrough is disclosed. This arrangement was developed for closing the sack and not for lifting the same. However, if used for lifting the sack, the positioning of the hoop below the top of the sack along with the large number of eyelets prevents the bag from maintaining a non-tilted orientation if lifted via the hoop. Similarly, the positioning of the strap below the top prevents the bag from being lifted by a lifting mechanism without manual alignment.

The prior art does disclose self-sustaining loops or straps which can be engaged without the assistance of an additional person. For example, see U.S. Pat No. 4,494,599 to Polett and Pat. No. 4,300,608. However, none of the prior art inventions, to applicant's knowledge, appear to have combined this self-sustaining feature with the non-tilt feature disclosed herein.

SUMMARY OF THE INVENTION

The present invention is designed to overcome the problems of the prior art described above and to produce a flexible bulk container which maintains a non-tilted orientation when lifted and which can be lifted by an operator and his machine without the assistance of an additional person to align the lifting means with the flexible bulk container.

The flexible bulk container is comprised of a top and bottom wall and an encircling side wall attached to the top and bottom walls. The container has a continuous elongated flexible hoop attached to the bag but positioned above the top wall. The hoop is attached to loops at each corner of the container and forms a rectangular shape substantially the same as the bag. The flexible hoop runs freely through loop members which extend upward above the top wall and are secured to the side wall at areas adjacent to each corner. Pockets are formed and attached to the sidewall at these same areas which extend from the top wall downward towards the bottom of the bag. The pockets are open at the top end and sewn closed at the bottom end and sides. Semi-rigid tubular members having open ends enclose and provide support to the loop members. They extend downward into the pockets and upward above the top wall enclosing the straight portion of the loop member. The loop extends above the tubular member's top end and engages the flexible hoop.

The flexible hoop can be engaged and lifted from any point on its length requiring no assistance to align a lifting mechanism with the flexible bag. Upon lifting, the rigid tubular members along with the loop members collapse together as the hoop pulls upward through the loops. The bag stays in the upright position because upon collapsing of the tubular and loop members, the hoop moves to the center of the bag.

The advantage of the instant invention results from its ability to be lifted and moved without the necessity of an additional person to align the lifting mechanism with the loops or straps on the bag. The hoop provides more sufficient room for the machine operator to align the forks of a forklift or a hook from a lifting crane or the like with the strap. The invention also has the benefit of remaining in the upright position while the bag is repositioned. Similar inventions tilt at a substantial angle causing difficulty in placing the bag at another position without further assistance. The hoop in the instant invention has the ability to remain at the center of the bag after it is lifted from any and all positions along the hoop perimeter.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 1:
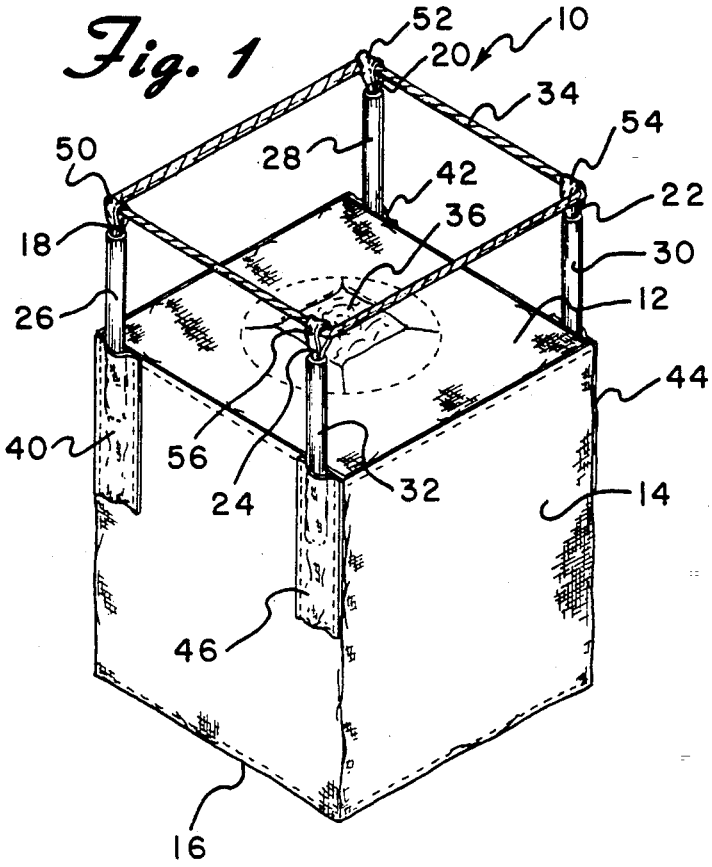
FIG. 1 is a perspective view of the flexible bag prior to lifting and constructed in accordance with the principles of the present invention.

Referring now to the drawings in detail wherein like reference numerals have been used throughout the various figures to designate like elements there is shown in FIG. 1 a perspective view of the flexible bag constructed in accordance with the principles of the present invention and designated generally as 10.

The flexible bag is comprised of a top wall 12, an encircling side panel 14, a bottom wall 16, four loop members 18, 20, 22 and 24, four semi-rigid members 26, 28, 30, 32 and an elongated hoop 34. The top wall 12, side panel 14 and bottom 16 are all sewn together to form the bag portion of the flexible bag. The four loop members 18, 20, 22 and 24 are sewn to the side wall and the four semi-rigid members 26, 28, 30 and 32 encircle the loop members. The elongated hoop 34 passes through the loop members.

Referring to FIG. 1, the top wall 12 is rectangularly shaped and constructed preferably of woven polypropylene or another desired material. The top wall has a filling spout 36 and closing means 38 located on the center which provides access to the interior of the bag portion and is constructed similarly to that shown in U.S. Pat. No. 4,523,204. The bottom wall 16 of the bag portion is also rectangularly shaped and constructed of the same material as the top wall 12.

In one embodiment of the invention, the side panel 14 may be rectangularly shaped while in a flat orientation. While attached to the top wall and the bottom, the side panel 14 creates an enclosure. The side panel is constructed from the same material as the top wall 12 and bottom wall 16. The side panel 14 is sewn at its top end to the top wall and sewn at its bottom end to the bottom wall of the flexible bag 10. While sewn to and between the top and bottom walls, the side wall 14 has four corners. Alternatively, it is also possible to construct the bag portion from two rectangular sheets of material folded to form a "U" and an inverted "U" which interfit with each other; one of said "U's" forming the top wall and opposing side walls while the other forms the bottom wall and the other two side walls.

At each corner, shown best in FIG. 1, the side wall has a pocket extending from the top wall downward toward the bottom wall for approximately 12 inches. The pockets 40, 42, 44 and 46 are sewn adjacent to each corner as shown in FIG. 1 for pockets 40 and 46. The pockets have an open end towards the top wall 12 and a closed end towards the bottom wall 16. They are constructed from the same material as the rest of the bag portion. The pockets are of a width to accommodate the loop members 18, 20, 22 and 24 to be sewn to the side wall area beneath the pockets and also to allow the semi-rigid members 26, 28, 30 and 32 to be slidingly secured therein.

Each corner of the flexible bag is substantially identical. Accordingly, only the corner having the loop member 18 attached thereto will be described in detail, it being understood that the following description applies equally to all corners.

The loop members 18 is sewn to the side wall underneath the pocket 40 along the bottom end portion of the straight portion of the loop member. The loop member 18 extends downward from the top wall 12 at a distance which allows for sufficient stitching, preferably at the two areas shown in FIG. 3, for providing strength to accommodate the heavy loads the bag portion carries. Also, there must be sufficient space to allow the tubular member 26 to provide adequate support to sustain the loop member in a vertical orientation. The loop members extend upward approximately eight inches with the semi-rigid tubular members enclosing the straight portion 48 of the loop members.

Figure 3:
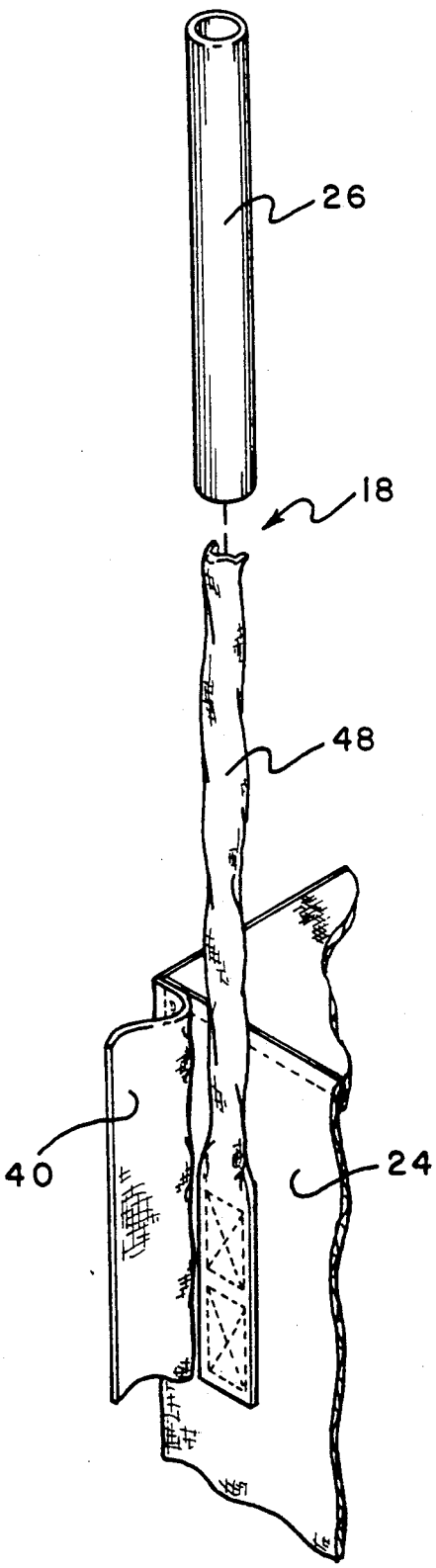
FIG. 3 is a perspective assembly view at one corner of the flexible bag illustrating the semi-rigid tubular member, the loop member, and the pocket which form parts of this invention.
Figure 4:
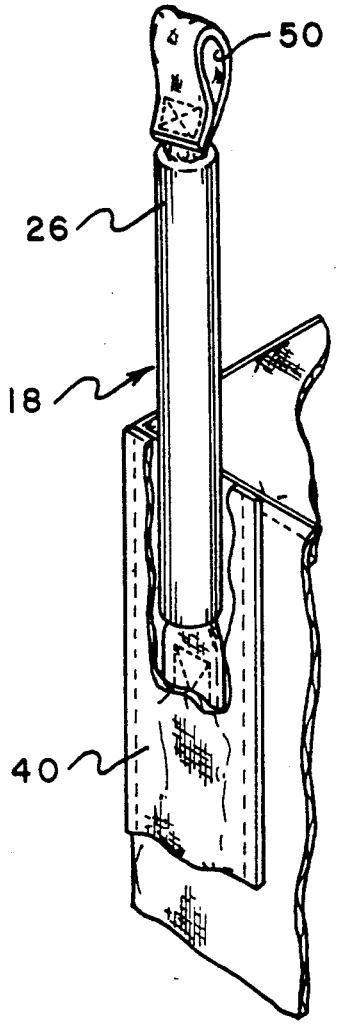
FIG. 4 is a perspective cutaway view of one corner of the flexible bag in its assembled orientation.
Figure 5:
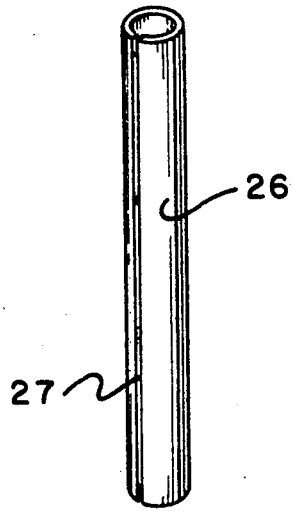
FIG. 5 is a perspective view of another form of the rigid tubular member.

The semi-rigid member 26 is tubular in shape and fits over the straight portion 48 of the loop members as shown in FIGS. 3 and 4. The semi-rigid members are preferably constructed from a rubber or plastic hose material. The semi-rigid tubular members fit over the straight portion 48 of the loop members allowing the loop portion 50, shown in FIGS. 3 and 4, and for the other loop members, 52, 54 and 56, to extend freely outside the tube section. The tubular member 26 extends downward approximately 10 inches and slidingly fits into the pocket 40. The loop portions are preferably formed after the loop members are inserted through the tubular members as shown in FIG. 3. However, it is also possible to slit the tubular member lengthwise as shown at 27 in FIG. 5 so that it can be placed around a preformed loop member or removed therefrom.

An elongated flexible lifting hoop 34 passes freely through each of the loop members 18, 20, 24, 26 at the loop portions 50, 52, 54 and 56, respectively. The ends of the hoop are secured together to form a continuous hoop. The hoop is preferably made from a web or rope-like material of sufficient strength to support the heavy loads the bag portion accommodates.

Figure 2:
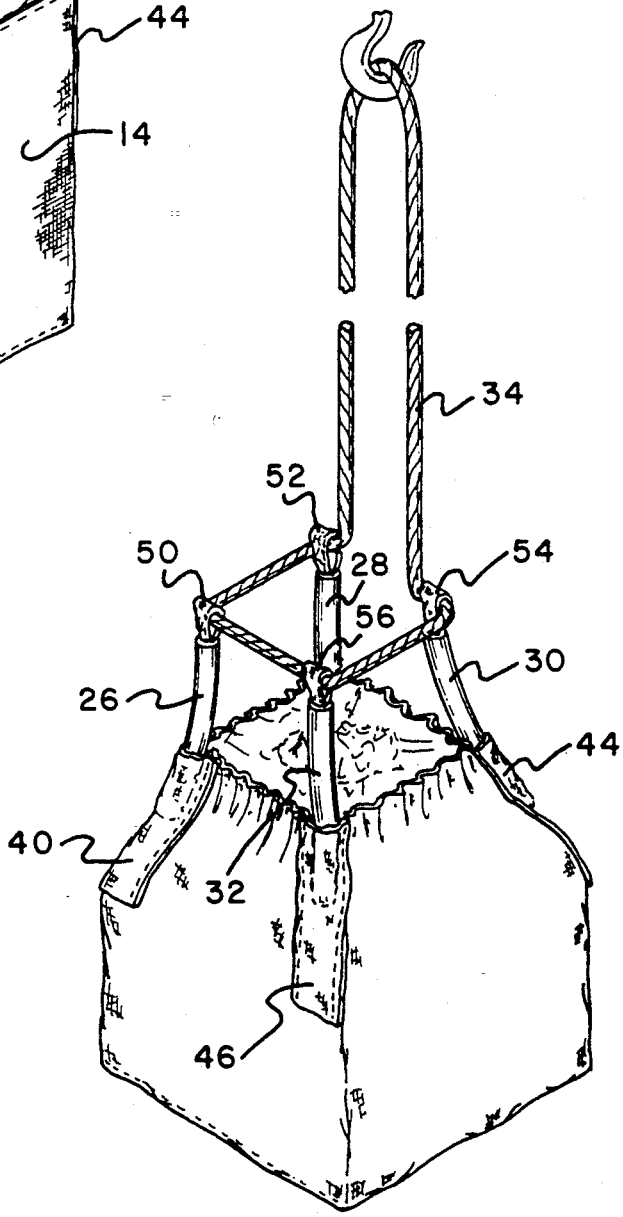
FIG. 2 is a perspective view of the flexible bag in the process of being lifted via a crane and the lifting hoop.

The flexible bag of the present invention is intended to be used in the following manner. The elongated lifting hoop 34 is used in the lifting process of the flexible bag 10. The hoop can be engaged from any side of the bag that is convenient to the lifting mechanism. Due to the heavy loads these bags carry, heavy equipment is normally used to assist a person in lifting the bag. Preferably a fork lift or a crane incorporating a hook at the end of a cable, as shown in FIG. 2 is used to lift the bag. No assistance from another person is required to accomplish lifting the flexible bag 10. The equipment operator need only place a fork of a fork lift or a hook from a crane at an position along the length of lifting hoop 34. Once the hoop is engaged by the lifting means, the operator commences upward movement of the lifting means until the bag moves off the ground as shown in FIG. 2. The rigid tubular members 26, 28, 30 and 32 along with the loop members 18, 20, 22 and 24 collapse inwardly towards the center of the bag. This results from the hoop moving through the loop portions 50, 52, 54, and 56 of the loop members and upwards. The hoop pulls the loop members upwards but because they are permanently attached to the bag portion, the loop members move towards each other. When the collapsing of the tubular and loop members is complete, the bag remains in a substantially upright orientation as shown in FIG. 2 which allows for easy movement and replacement of the flexible bag 10 at another position.

The present invention may be embodied in other specific forms without departing from the spirit or essential attributes thereof and accordingly reference should be made to the appended claims rather than to the foregoing specification as indicating the scope of the invention.

What is claimed is:

1. A flexible bulk container comprising:

a bag portion including a bottom wall and an encircling side panel connected to said bottom wall and defining an outer perimeter of said bag portion;

a plurality of support loop members permanently affixed to said side panel of said bag portion and spaced apart along said side panel, the upper end of each of said loop members extending upwardly beyond the top of said side panel and the opposite end of each of said loop members extending downwardly along and being attached to said side panel, each loop member being comprised of a substantially straight portion having a loop at said upper end;

means for maintaining said loop members in an upwardly extending orientation;

an elongated flexible member passing freely through said loop of said loop members, said flexible member forming a continuous hoop which lies substantially entirely above the top of said side panel and spaced therefrom and being adapted to be engaged by a lifting means without requiring manual alignment of said flexible member with said lifting means, said flexible member maintaining said flexible container in a substantially upright orientation while said container is being lifted and moved.

2. The invention according to claim 1 wherein said maintaining means comprises vertically extending tubular members enclosing said straight portions of said loop members, each of said tubular members extending upwardly above said side panel and extending downwardly within pockets sewn onto said side panel.

3. The invention according to claim 2 wherein said bottom wall is rectangularly shaped whereby said bag portion has four corners, said outer perimeter of said side panel has one of said loop members permanently sewn thereto adjacent each corner.

4. The invention according to claim 3 wherein said at another position. pockets are sewn to said side panel adjacent each of said corners and covering the portion of said loop members that extends downwardly below the top of said side panel, said pockets being open at their tops and being closed at their bottoms, said pockets extending from adjacent the top of said side panel towards said bottom wall.

5. The invention according to claim 4 wherein said tubular members are tubularly shaped and substantially rigid, having open ends and being fitted within said pockets.

6. The invention according to claim 1 further including a top wall.

7. The invention according to claim 6 wherein said top wall has an opening for access to an interior portion of said bag portion.

* * * * *

UNITED STATES PATENT AND TRADEMARK OFFICE

CERTIFICATE OF CORRECTION

PATENT NO. : 5,161,853

DATED : November 10, 1992

INVENTOR(S) : Walter J. Polett

It is certified that error appears in the above-identified patent and that said Letters Patent is hereby corrected as shown below:

Column 6, lines 6 and 7, "at another position" is deleted.

Signed and Sealed this

Fifth Day of October, 1993

*Attest:*

*Attesting Officer*

BRUCE LEHMAN

*Commissioner of Patents and Trademarks*